US007367524B2

(12) United States Patent
Burnett

(10) Patent No.: US 7,367,524 B2
(45) Date of Patent: May 6, 2008

(54) PIVOTING TOILET TISSUE ROLL HOLDER WITH AUXILIARY TOILET TISSUE

(76) Inventor: Allen Garrett Burnett, 3184 Rock Creek Dr., Rex, GA (US) 30273-2440

( * ) Notice: Subject to any disclaimer, the term of this patent is extended or adjusted under 35 U.S.C. 154(b) by 165 days.

(21) Appl. No.: 11/406,539

(22) Filed: Apr. 18, 2006

(65) Prior Publication Data

US 2007/0267534 A1 Nov. 22, 2007

(51) Int. Cl.
*B65H 18/04* (2006.01)

(52) U.S. Cl. ..... 242/598.2; 242/599.3

(58) Field of Classification Search ..... 242/598.2, 242/598.1, 594, 598.4, 598.5, 598.6, 599, 242/599.3

See application file for complete search history.

(56) References Cited

U.S. PATENT DOCUMENTS

| | | | | |
|---|---|---|---|---|
| 1,136,700 | A | 4/1915 | Moore | |
| 2,518,328 | A | 8/1950 | Janonis | |
| 2,801,809 | A * | 8/1957 | Glaner | 242/560 |
| 3,022,957 | A * | 2/1962 | Blunt et al. | 242/598.2 |
| 3,157,370 | A * | 11/1964 | Govatsos | 242/560.2 |
| 4,824,038 | A * | 4/1989 | Chandler | 242/598.2 |
| 4,836,462 | A * | 6/1989 | Bruss | 242/598.2 |
| 5,255,861 | A * | 10/1993 | Lerner | 242/598 |
| 5,718,396 | A * | 2/1998 | Maresca | 242/598.2 |
| 5,868,344 | A * | 2/1999 | Melnick | 242/591 |
| 6,007,019 | A * | 12/1999 | Lynch | 242/598.2 |
| 2002/0020780 | A1 * | 2/2002 | Otsuji | 242/598.2 |

* cited by examiner

*Primary Examiner*—William A. Rivera

(57) ABSTRACT

A wall mounted holder to support a standard toilet tissue roll, and within a pivoting hollow axle contain an auxiliary tissue roll. The attached axle pivots by mechanical means for manipulation of the standard toilet tissue roll and the auxiliary tissue roll. The axle outer diameter is slightly less than the inner diameter of a standard toilet tissue roll center tube allowing the hollow compartment of the axle to provide the maximum space for the auxiliary tissue roll. Auxiliary tissue is tightly rolled and contained in the hollow compartment of the axle.

14 Claims, 3 Drawing Sheets

PIVOTING TOILET TISSUE ROLL HOLDER WITH AUXILIARY TOILET TISSUE

RELATED APPLICATIONS

Applicant filed patent application Ser. No. 11/182,978 on Jul. 15, 2005 for a Toilet Tissue Roll Holder Axle With Auxiliary Tissue. The present application is similar in nature to that pending application in having a compartment for storing auxiliary toilet tissue.

Applicant filed patent application Ser. No. 11/357,571 on Feb. 17, 2006 for a Wall Mount Toilet Tissue Roll Holder With Auxiliary Tissue. The present application is similar in nature to that pending application in being wall mounted and having a compartment for storing auxiliary toilet tissue.

Applicant filed patent application Ser. No. 11/395,037 on Mar. 31, 2006 for a Wall Mount Mechanical Toilet Tissue Roll Holder With Auxiliary Tissue. The present application is similar in nature to that pending application in being wall mounted and having a compartment for storing auxiliary toilet tissue.

FIELD OF THE INVENTION

The present invention relates to toilet tissue holders and, more particularly, to a wall mounted, pivoting, toilet tissue roll holder with a compartment for auxiliary toilet tissue.

BACKGROUND OF THE INVENTION

Since the invention of indoor plumbing, people have occasionally been stranded on a toilet without toilet tissue because they did not realize there was very little, or none at all nearby when they took a seat. Using whatever alternative material was within reach, moving awkwardly around the restroom area searching for toilet tissue, or calling for help were a few of the available remedies. But ideally, someone discovering an inadequate or depleted supply of standard toilet tissue after beginning their use of a toilet, would have access to an auxiliary supply of tissue within an arm's length of that toilet which would be less prone to outages.

Devices to house additional standard toilet tissue rolls in the proximity of a toilet can be found in great number.

Small packages of all sorts of tissue types can be found in great number.

Small rolls of tissue, and dispensers for those rolls are produced for camping or other portable purposes.

The need to solve the problem of running out of toilet tissue while utilizing a toilet is long established. U.S. Pat. No. 2,801,809 filed May 6, 1954 and issued Aug. 6, 1957 to L. O. Glaner addressed the problem.

U.S. Pat. No. 5,255,861 issued Oct. 26, 1993 to Saul Lerner also addressed the problem.

Primary, wall mounted holders for the use of standard toilet tissue rolls, and devices for storage of additional standard toilet tissue rolls, when empty, require replenishment of their supply of standard toilet tissue roll or rolls. They have no provision for a smaller auxiliary amount of tissue when inevitably the need for replenishment is overlooked or ignored.

Camping and other portable-need toilet tissue products are designed for an outdoor application, are large as designed for several uses, and have no capability to be included conveniently in the indoor restroom environment.

The device in U.S. Pat. No. 2,801,909 to Glaner long ago recognized the best location for an auxiliary tissue supply as being the interior of the center tube of a standard toilet tissue roll, and more specifically inside the spindle of a holder. But the Glaner device claims cite the device as being a spindle for turning, for turning movement, and rotatably supporting the spindle. There is no provision to assemble the device without trunions, springs and other parts specific to a spindle. Glaner is a rotating, spring-held spindle for use in a specific type and specific size of holder.

The device in U.S. Pat. No. 5,255,861 to Lerner also recognizes the best location for an auxiliary tissue supply as inside the tube of a toilet tissue roll. Lerner is a tissue roll for use with a specific type spindle and a specific size of holder.

SUMMARY OF THE INVENTION

In accordance with the present invention, there is provided a wall mounted, pivoting holder to support a standard toilet tissue roll, and within an axle in a hollow compartment contain an auxiliary tissue roll. The axle outer diameter is slightly less than the inner diameter of the standard toilet tissue roll's center tube, allowing the hollow compartment of the axle to provide the maximum space for the auxiliary tissue roll. The auxiliary tissue roll is tightly wound and contained in the hollow compartment of the axle.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE A PREFERRED EMBODIMENT

The situation can be solved by a toilet tissue roll holder with a space for auxiliary toilet tissue. Since standard toilet tissue rolls designed for home use have a universal length and inside diameter, that space should set the standard for an auxiliary tissue size.

The invention is a wall mounted, pivoting, toilet tissue roll holder. The invention has a hollow compartment inside an axle where an auxiliary tissue roll is stored.

An amount of toilet tissue necessary for only a single user is required when discovery of an inadequate or depleted supply of toilet tissue is made at an inopportune time. The invention provides at least that amount of auxiliary tissue by maximizing the size of the storage space relative to the inside diameter of standard toilet tissue rolls.

The auxiliary tissue roll of the invention can be removed and the hollow compartment used instead to store other personal hygiene products or other items sometimes required when utilizing a toilet and no other close or discreet storage location is available.

Most standard toilet tissue roll holders have spindles much smaller than the center tube of standard toilet tissue rolls causing wobbling when unrolling. The invention has an axle only slightly smaller than the center tube of standard toilet tissue rolls and provides a smooth unrolling action.

It is therefore an object of the invention to provide a permanently affixed device capable of a pivoting action to store an auxiliary tissue roll in close proximity to those who did not realize there was an inadequate supply of toilet tissue at their disposal before circumstances prevented them from moving about comfortably beyond the immediate area of a toilet they were utilizing.

It is another object of the invention to provide an auxiliary tissue roll of a certain size to fit into the storage area of the invention.

It is another object of the invention to provide a permanently affixed device for dispensing a standard toilet tissue roll.

It is another object of the invention to provide a storage location for personal-hygiene supplies or other items in a permanent fixed position within an arm's reach of a toilet.

It is another object of the invention to provide an auxiliary tissue roll of a size that can be transported on one's person discreetly.

Figure 1:
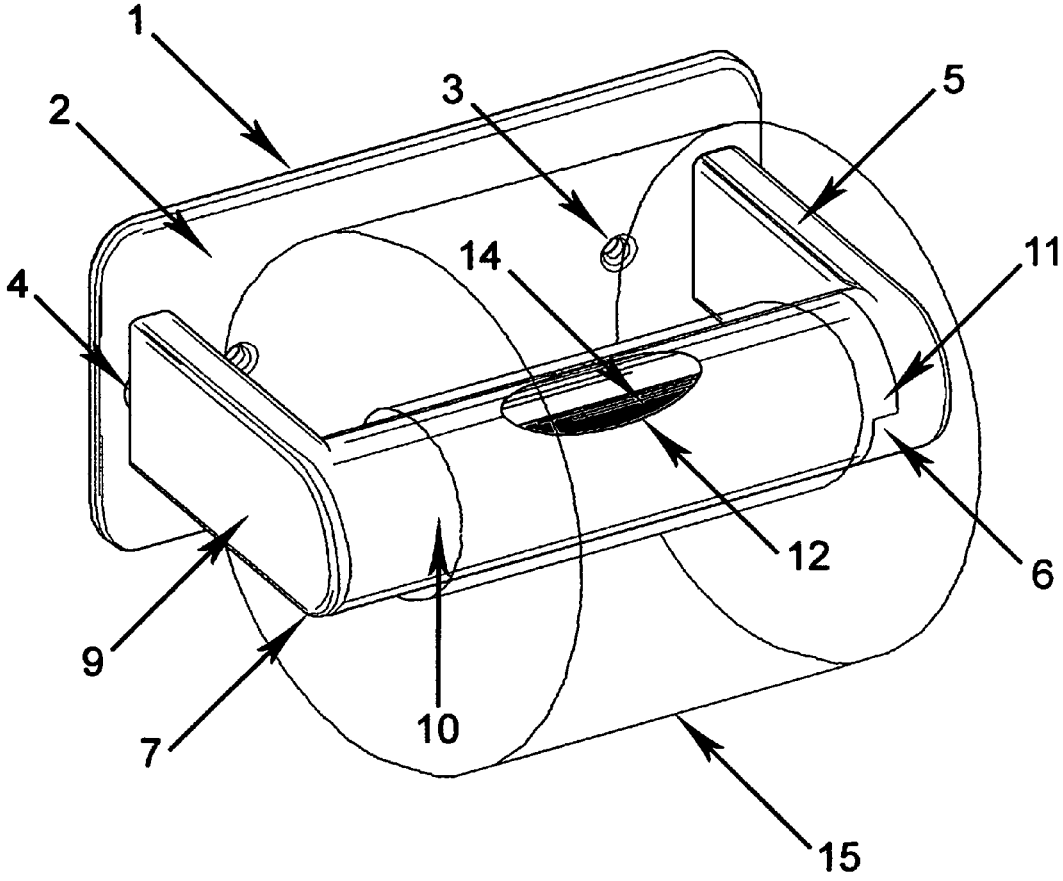
FIG. 1 is a front perspective static view of a wall mounted, pivoting, toilet tissue roll holder with auxiliary toilet tissue in accordance with the invention.

FIG. 1 is a front perspective static view of a wall mount, pivoting, toilet tissue roll holder with auxiliary toilet tissue in accordance with the invention.

A main component 1 consisting of a base plate 2, a pivot base 4, a stationary arm 5, and an axle ledge 6 is made of plastic, metal, wood or other suitable material. The main component 1 can be constructed as one piece or as multiple pieces. The base plate 2 establishes contact with, and alignment to, a wall or other mounting surface. The main component 1 is attached to the wall or other mounting surface at the base plate 2 using a mounting device 3. In this embodiment the mounting device 3 is visible holes for screws. The mounting device 3 can be mechanical, adhesive or other suitable systems. The mounting device 3 can be visible or hidden. The stationary arm 5 extends from the base plate 2 to align the axle ledge 6. The axle ledge 6 extends from the stationary arm 5 to limit pivot movement.

A pivoting component 7 consisting of a pivot arm 9, a hollow axle 10, a finger hole 12, and an axle overhang 11 is made of plastic, metal, wood or other suitable material. The pivoting component 7 can be constructed as one piece or as multiple pieces. The pivot arm 9 rotates on the pivot base 4. The axle 10 extends from the pivot arm 9 to align with the axle ledge 6. The finger hole 12 is a void in the top of the axle 10 to allow additional access to the hollow interior. The axle overhang 11 rests on the axle ledge 6 to support the axle 10. The hollow axle 10 provides space for an auxiliary tissue roll 14. A standard toilet tissue roll 15 is mounted on the axle 10. The axle 10 diameter allows the standard toilet tissue roll 15 to spin freely.

Figure 2:
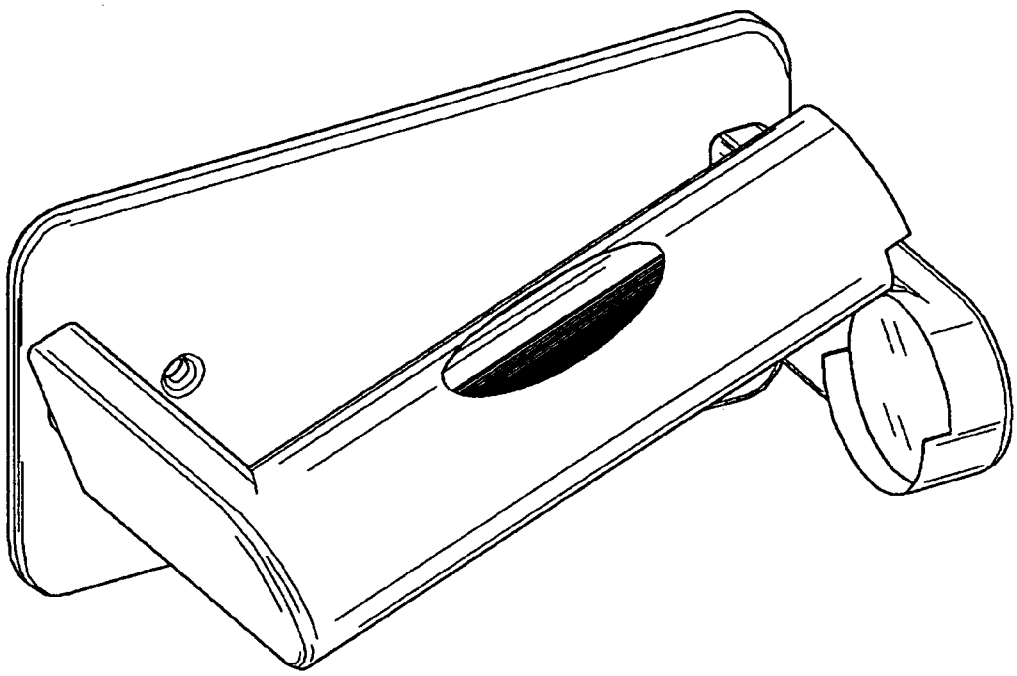
FIG. 2 is a front perspective dynamic view of a wall mounted, pivoting, toilet tissue roll holder in accordance with the invention.

FIG. 2 is a front perspective dynamic view of the invention in a pivoted position. The pivoting action allows manipulation of the tissue items.

Figure 3:
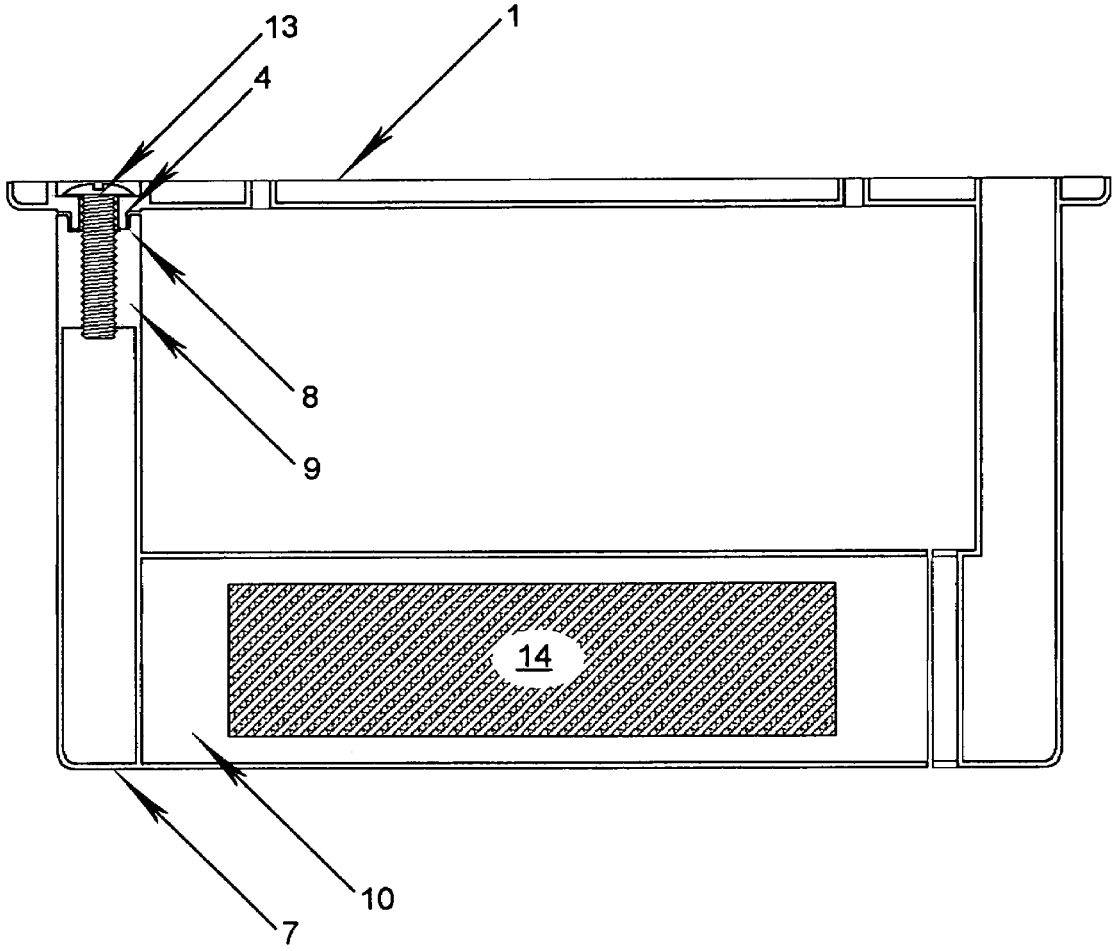
FIG. 3 is a top sectional static view of a wall mounted, pivoting, toilet tissue roll holder in accordance with the invention.

FIG. 3 is a top sectional static view of the invention. The pivot base 4 mounts in a pivot socket 8 in the pivot arm 9. An assembly mechanism 13 joins the main component 1 and the pivoting component 7 allowing pivot movement. In this embodiment the assembly mechanism 13 is a bolt passing thru the pivot base 4 and threaded into the pivot arm 9. The assembly mechanism 13 can be one piece or multiple pieces. The assembly mechanism 13 can be mechanical, adhesive, or other suitable systems. The assembly mechanism 13 can be visible or hidden. The auxiliary tissue roll 14 is stored inside the axle 10.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A pivoting toilet tissue roll holder with auxiliary toilet tissue for providing auxiliary tissue at a toilet, comprising:

means for establishing contact and alignment with a mounting surface;

means for securing a main component to the mounting surface, fastened to said means for establishing contact and alignment with the mounting surface;

means for aligning the main component with a pivot socket, directly formed to said means for establishing contact and alignment with the mounting surface;

means for aligning an axle ledge with an axle overhang, rigidly connected to said means for establishing contact and alignment with the mounting surface;

means for limiting movement of a pivoting component and supporting the axle overhang, directly formed to said means for aligning the axle ledge with the axle overhang;

means for aligning the pivoting component with a pivot base, moveably inserted to said means for aligning the main component with the pivot socket;

means for supporting and pivoting an axle, directly formed to said means for aligning the pivoting component with the pivot base;

means for containing the auxiliary tissue and supporting an outer toilet tissue roll, rigidly connected to said means for supporting and pivoting the axle, wherein the means for containing the auxiliary tissue and supporting the outer toilet tissue roll comprises a finger hole;

means for supporting the axle on the axle ledge, directly formed to said means for containing the auxiliary tissue and supporting the outer toilet tissue roll; and means for joining the main component to the pivoting component, connected to said means for aligning the pivoting component with the pivot base, and connected to said means for aligning the main component with the pivot socket;

wherein the auxiliary toilet tissue is inserted to said means for containing the auxiliary tissue and supporting the outer toilet tissue roll.

2. The pivoting toilet tissue roll holder with auxiliary toilet tissue in accordance with claim 1, wherein said means for establishing contact and alignment with the mounting surface comprises a substantially flat base plate.

3. The pivoting toilet tissue roll holder with auxiliary toilet tissue in accordance with claim 1, wherein said means for securing a main component to a mounting surface comprises a mechanical or adhesive mounting device.

4. The pivoting toilet tissue roll holder with auxiliary toilet tissue in accordance with claim 1, wherein said means for aligning the main component with the pivot socket comprises a pivot base.

5. The pivoting toilet tissue roll holder with auxiliary toilet tissue in accordance with claim 1, wherein said means for aligning the axle ledge with the axle overhang comprises a stationary arm.

6. The pivoting toilet tissue roll holder with auxiliary toilet tissue in accordance with claim 1, wherein said means for limiting movement of the pivoting component and supporting the axle overhang comprises an axle ledge.

7. The pivoting toilet tissue roll holder with auxiliary toilet tissue in accordance with claim 1, wherein said means for aligning the pivoting component with the pivot base comprises a pivot socket.

8. The pivoting toilet tissue roll holder with auxiliary toilet tissue in accordance with claim 1, wherein said means for supporting and pivoting the axle comprises a pivot arm.

9. The pivoting toilet tissue roll holder with auxiliary toilet tissue in accordance with claim 1, wherein said means for containing the auxiliary tissue and supporting the outer toilet tissue roll comprises a hollow axle.

10. The pivoting toilet tissue roll holder with auxiliary toilet tissue in accordance with claim 1, wherein said means for supporting the axle on the axle ledge comprises an axle overhang.

11. The pivoting toilet tissue roll holder with auxiliary toilet tissue in accordance with claim 1, wherein said means for joining the main component to the pivoting component comprises a mechanical or adhesive assembly mechanism.

12. The pivoting toilet tissue roll holder with auxiliary toilet tissue in accordance with claim 1, wherein said auxiliary toilet tissue comprises a wound auxiliary tissue roll.

13. A pivoting toilet tissue roll holder with auxiliary toilet tissue for providing auxiliary tissue at a toilet, comprising:

a base plate;

a mechanical or adhesive mounting device fastened to said base plate;

a pivot base formed to said base plate;

a stationary arm connected to said base plate;

an axle ledge formed to said stationary arm;

a pivot socket moveably inserted to said pivot base;

a pivot arm formed to said pivot socket;

a hollow axle connected to said pivot arm;

an axle overhang formed to said axle;

a mechanical or adhesive system assembly mechanism connected to said pivot base;

a wound auxiliary tissue roll inserted into said axle; and a finger hole directly formed to said axle.

14. A pivoting toilet tissue roll holder with auxiliary toilet tissue for providing auxiliary toilet tissue at a toilet, comprising:

a substantially flat base plate, for establishing contact and alignment with a mounting surface;

a mechanical or adhesive mounting device, for securing the base plate to the mounting surface, suitably fastened to said base plate;

a pivot base formed to said base plate;

a stationary arm directly formed to said base plate;

an axle ledge directly formed to said stationary arm;

a pivot socket, for aligning a pivoting component with the pivot base, moveably inserted to said pivot base;

a pivot arm, for supporting and pivoting an axle, directly formed to said pivot socket;

a hollow axle, for containing an auxiliary tissue roll, and supporting an outer toilet tissue roll, rigidly connected to said pivot arm;

an axle overhang, for supporting an axle on an axle ledge, directly formed to said axle;

a mechanical or adhesive assembly mechanism, for joining the base plate to a pivoting component dynamically, operationally connected to said pivot socket, and operationally connected to said pivot base; and an auxiliary tissue roll inserted into said axle.

* * * * *